US009003671B2

(12) United States Patent
Wang

(10) Patent No.: US 9,003,671 B2
(45) Date of Patent: Apr. 14, 2015

(54) TAPERING JIG FOR A WOODWORKING APPARATUS

(71) Applicant: Micro Jig, Inc., Winter Springs, FL (US)

(72) Inventor: Henry Wang, Winter Springs, FL (US)

(73) Assignee: Micro Jig, Inc., Winter Springs, FL (US)

( * ) Notice: Subject to any disclaimer, the term of this patent is extended or adjusted under 35 U.S.C. 154(b) by 177 days.

(21) Appl. No.: 13/755,240

(22) Filed: Jan. 31, 2013

(65) Prior Publication Data

US 2014/0208912 A1 Jul. 31, 2014

(51) Int. Cl.
*B27B 27/08* (2006.01)
*B27B 25/10* (2006.01)

(52) U.S. Cl.
CPC ..... *B27B 27/08* (2013.01); *B27B 25/10* (2013.01)

(58) Field of Classification Search
USPC ..... 33/640, 641, 642, 534, 537, 628, 626, 33/633, 832, 833, 836
See application file for complete search history.

(56) References Cited

U.S. PATENT DOCUMENTS

| | | | | |
|---|---|---|---|---|
| 2,735,182 | A | 2/1956 | Kalberer | |
| 3,736,666 | A * | 6/1973 | Sutter | 33/537 |
| 4,112,581 | A * | 9/1978 | Hornsby | 33/534 |
| 4,514,909 | A | 5/1985 | Gilbert | |
| 4,669,227 | A * | 6/1987 | Treppner | 33/537 |
| 4,884,604 | A * | 12/1989 | Rice et al. | 33/537 |
| 4,940,067 | A * | 7/1990 | Beard | 33/537 |
| 5,379,669 | A | 1/1995 | Roedig | |
| 5,493,789 | A | 2/1996 | Duginske | |
| 5,737,990 | A * | 4/1998 | Freeland et al. | 83/767 |
| 5,845,410 | A | 12/1998 | Boker | |
| 6,164,176 | A | 12/2000 | Larsson | |
| 6,256,900 | B1 | 7/2001 | Myers | |
| 6,499,224 | B1 * | 12/2002 | Asick | 33/628 |
| 6,672,190 | B2 | 1/2004 | Taylor | |
| 7,040,206 | B2 | 5/2006 | Wang | |
| 7,421,798 | B2 | 9/2008 | Pattee | |
| 7,540,224 | B2 | 6/2009 | Wang | |
| 7,587,838 | B2 * | 9/2009 | Mastrobattista | 33/640 |
| 7,886,455 | B1 | 2/2011 | Stojkovic | |
| 8,584,372 | B2 * | 11/2013 | Stoffel | 33/628 |
| 2014/0208912 | A1 * | 7/2014 | Wang | 83/444 |

* cited by examiner

*Primary Examiner* — Yaritza Guadalupe-McCall
(74) *Attorney, Agent, or Firm* — Robert L. Wolter, Esq.; Beusse Wolter Sanks & Maire, P.A.

(57) ABSTRACT

A tapering jig for a woodworking apparatus that includes a top and bottom plate that pivot relative to one another to set a cutting angle of a work piece. The jig further includes at least one scale of one or more markings that represent a cutting angle and/or a "rise and run" measurement. In addition, a dial is positioned relative to the at least one scale to identify and set the cutting angle and/or "rise/run" measurement. The dial includes a plurality of pointers and a plurality of pins and each pin is associated with a respective pointer. Consecutive pins are offset incrementally from the respective pointers so that each pointer can be inserted in the same recess adjacent to the scale to incrementally adjust the cut angle and/or "rise/run" measurement.

16 Claims, 10 Drawing Sheets

10

TAPERING JIG FOR A WOODWORKING APPARATUS

BACKGROUND OF THE INVENTION

This invention relates generally to the field of woodworking tools, and more particularly to the field of accessories for setting the angle at which a stock material is presented for cutting.

Often times it may be necessary to taper a work piece. Wood working accessories used in connection with woodworking apparatuses are available to adjust an angle at which a work piece is disposed relative to a cutting element, such as saw blade. A woodworking apparatus typically includes a guide rail against which a work piece is positioned for guiding the work piece through the cutting element for cutting. A tapering accessory may be provided including an edge or surface between the guide rail and the cutting element, and the angle at which the accessory edge is disposed relative to the cutting element is adjustable in order to adjust an angle at which a work piece is presented for cutting.

However, many such accessories may include multiple moving parts to that can be cumbersome to use with woodworking apparatuses. Moreover, many such accessories are limited by the number of angles at which the work piece may be adjusted for cutting. Typically such accessories are capable of adjusting angles at 0.25°, and sometimes woodworking may be required to make more precise angled cuts. Accordingly, a need exists for a tapering jig or accessory for a woodworking apparatus that is easy to operate and provides for smaller incremental angle adjustments for more precise tapering of work pieces.

In addition, when using woodworking devices one may often work from drawings or plans that specifically identify angles for adjusting the cut angle of a work piece, and accessories include corresponding angle adjustments. However, one may work from plans or drawings that don't include angles or one may not use drawings at all. In such cases, a "run and rise" or "run over rise" calculation is made to determine a cut angle or an amount of material that needs to be removed from and end of a work piece at which a cut is finished. Once a calculation is made a line is drawn on the work piece representing the desired taper, and the cut is made by essentially "eyeballing" the cut along the drawn line. As expected such a procedure may lead to errors in the cut. The inventor of the subject invention is not aware of an accessory that provides a gauge or scale that includes adjustments for "rise and run" calculations or measurements.

BRIEF DESCRIPTION OF THE DRAWINGS

These and other advantages of the invention will become more apparent from the following description in view of the drawings. Similar structures illustrated in more than one figure are numbered consistently among the drawings.

DETAILED DESCRIPTION OF THE INVENTION

Figure 1:
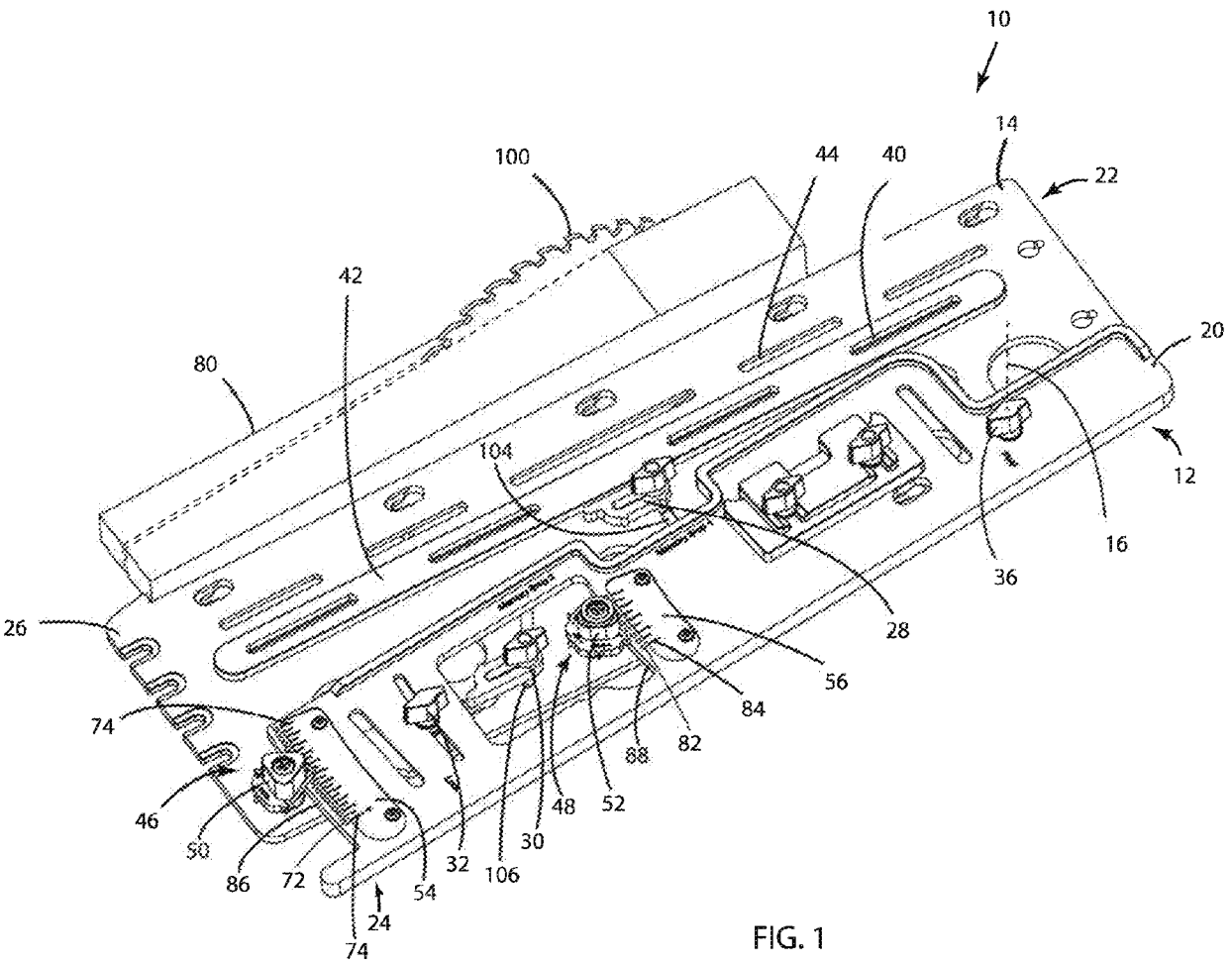
FIG. 1 is a perspective view of a tapering jig for a woodworking apparatus with a wood stock material in accordance with the present invention.
Figure 2:
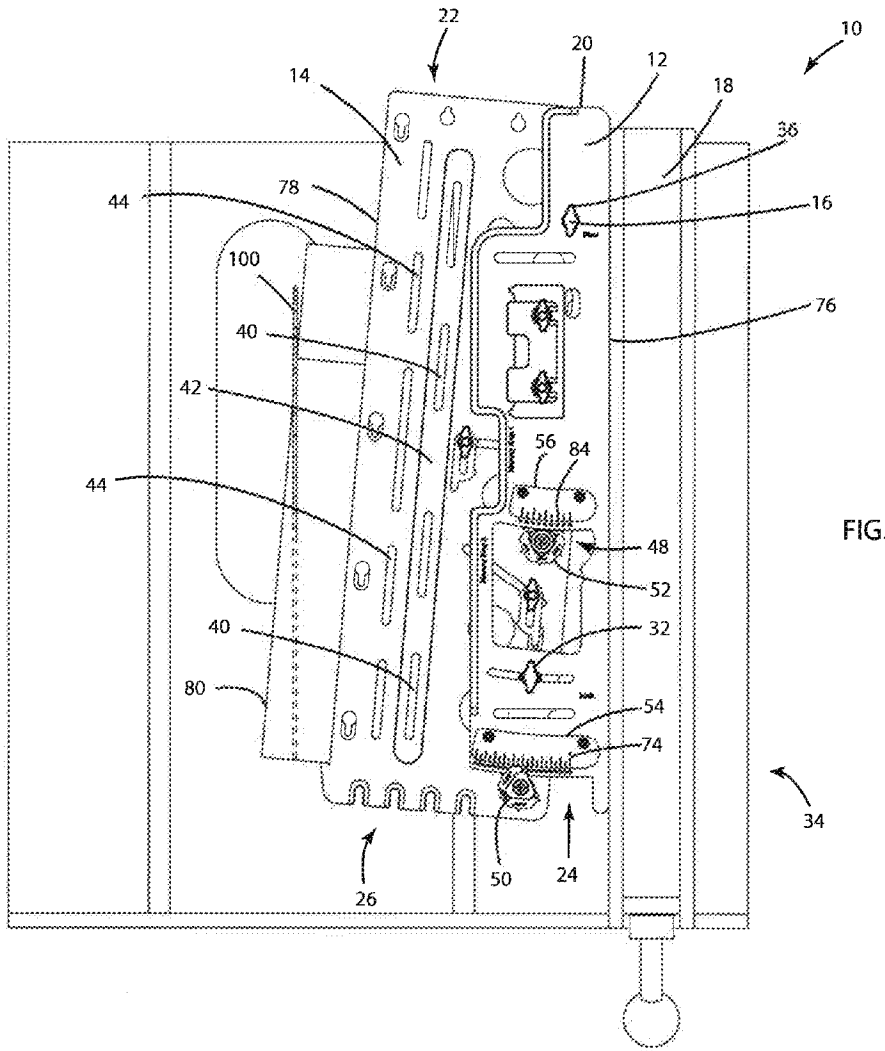
FIG. 2 is top view of a tapering jig used in conjunction with a guide rail of a woodworking apparatus and a wood stock material in accordance with the present invention.

The inventor has developed a tapering jig for use with a woodworking apparatus such as a table saw or router that provides a simple operation to adjust a cutting angle of a stock material at small angular increments. FIGS. 1 and 2 illustrate a tapering jig 10 that may be used as part of a woodworking apparatus 34, such as a table saw, for making cuts along a line that is not parallel to an opposed edge of the stock material. Such taper cuts are known to be useful for making tapered table legs, for example. Tapering jig 10 includes a bottom plate 14 and a top plate 12 pivotally joined at pivot axis 16. More specifically, the top plate 12 includes a first end 20 and a second end 24, and the bottom plate includes a first end 22 and second end 26. The top plate 12 and bottom plate 14 are pivotally connected at the pivot axis 16 towards the first ends 20, 22 of the respective plates 12, 14.

As shown in FIGS. 1 and 2, the tapering jig 10 may be used with a wood working apparatus 34 that includes a guide rail 18. The tapering jig 10 includes a first side edge 76 along the top plate 12 that abuts the guide rail 18, and a second side edge 78 against which the work piece 80 is secured. The bottom plate 14 may be moved or pivoted such that second edge 78 forms a selected angle with respect to first edge 76 and/or the guide rail 18. When the work piece 80 is positioned against the second side edge 78 for cutting, the work piece is disposed at the selected angle relative to a saw blade 100. As explained in more detail below, the angle there between may be indicated by the relative location of markings 74, 84 on scales 54, 56. The term angle as used herein to refer to the angle at which the second edge 78 is disposed relative to the first edge 76 or guide rail 18, the angle at which a work piece is disposed relative, a cut angle or an angle of a taper refers and shall include not only angle is expressed or measured in degrees or radial measurements, but shall also include any angle resulting from a "rise and run" calculation or measurement.

Once the bottom plate 14 is positioned in such a tapering configuration to a selected angle, locking knob 32 is tightened to fix the two plates 12, 14 in their relative positions. In addition, a locking knob 36 at the pivot axis 16 may be tightened to secure the plates 12, 14 in their relative positions. The tapering jig 10 preferably includes a handle (not shown mounted on a raised rail 42, which includes grooves 40 for positioning handle at multiple locations on the tapering jig 10. A secondary set of grooves 44 may be provided for attachment of a straddle pushing system as disclosed in U.S. Pat.

No. 7,040,206, which is incorporated herein by reference, for pushing the work piece 80 with the tapering jig 10 for cutting.

Figure 3:
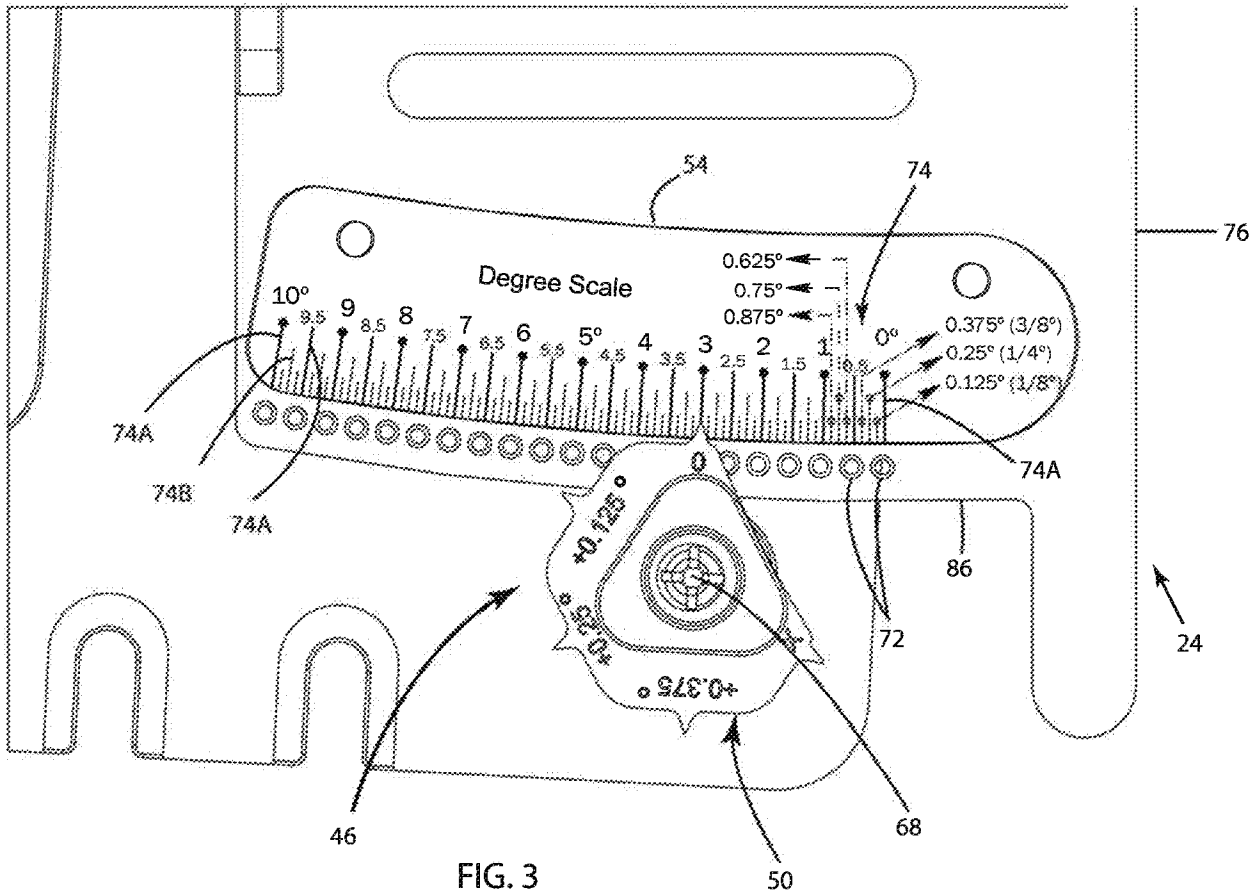
FIG. 3 is a top view of a gauge of a tapering jig for a woodworking apparatus in accordance with the present invention.

The embodiment shown in FIGS. 1 and 2 includes two gauges 46, 48 to incrementally adjust the positioning of the second edge 78 relative to the first edge 76 or guide rail 18 to taper the work piece 80 to be cut. Although the embodiment disclosed herein includes two gauges 46, 48, the tapering jig 10 may include only one of the gauges 46, 48 to adjust an angle at which the work piece is presented for cutting. The first gauge 46 is disposed at the second ends 24, 26 of the respective plates 12, 14 and includes a plurality of recesses 72 formed in the top surface of the top plate 12 along an edge 86 that extends generally laterally relative to the first and second side edges 76, 78 of the tapering jig 10. The first gauge 46 also includes a first dial 50 that is mounted to the bottom plate 14 adjacent to the lateral edge 76 and recesses 72. The first dial 50 is rotatable about a central axis 68 (FIG. 3), and, as will be explained in more detail below, is moveable up and down to engage the top plate 12 at the recesses 72 to secure the top plate 12 and bottom plate 14 relative to one another at a selected position to create a desired angle for cutting the work piece 80. The first gauge 46 includes a scale 54 that includes marking for selecting the cutting angle setting in degrees, and each marking 74 is associated with a corresponding recess 72.

Similar to the first gauge 46, the second gauge 48 also includes a dial 52 that is rotatable about a central axis 52A (FIG. 10A) and is moveable up and down. The second dial 52 is disposed on the bottom plate 14 between the first gauge 46 and the pivot axis 16. A plurality of recesses 82 are formed along an edge 88 that are disposed generally laterally relative to the first and second side edges 76, 78 of the tapering jig 10. The second gauge 48 includes a scale 56 for measuring settings based on a rise/run measurement that represent lateral measurements of an amount of material to be removed from end 80A (FIG. 10) of the work piece 80. The lateral edges 86, 88 for each respective gauge 46, 48 are generally arcuate having a radius of curvature determined based on a circle having center at the pivot axis 16. For example, the first gauge 46 may be spaced about nineteen inches from the pivot axis, and the first lateral edge 86 represents a perimeter of circle having a fourteen inch radius taken from taken from the pivot axis 16. Providing such curved edges, as opposed to a straight edge perpendicular to the first side edge 76, allows the top plate 12 and bottom plate 14 to be pivoted relative to one another a greater distance, as compared to a straight edge which may hit the dial 50. The arc-shaped edge also enables selection of a greater number of cutting angles. As noted above, while the embodiment shown in FIGS. 1 and 2 includes two gauges 46, 48, the invention is intended to encompass embodiments with only a single gauge or possibly more than two gauges.

On each scale 54, 56, the markings 74, 84 are provided for selecting cutting angles or run/rise measurements, and each marking 74, 84 is associated with a recess 72, 82 of the respective gauges 46, 48. With respect to the first scale 54 first markings 74A are provided every 0.5°. In between, each first marking 74A, additional markings 74B (secondary markings) are provided, for example at every ⅛° (0.125°). These additional markings 74B are also associated with the same recess 72 as one of the first markings 74A. Similarly, the second gauge 48 includes first and second markings 84A, 84B that are associated with a respective recess 82. The markings 84A, 84B set a cutting angle using "rise and run" measurements, which may be preferred by some, and will be explained below in more detail.

Figure 5:
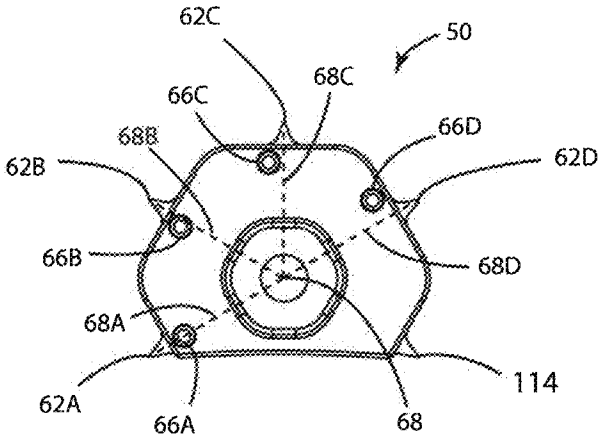
FIG. 5 is a bottom view of a dial illustrating incremental offset of pins for incremental adjustment of a cutting angle in accordance with the present invention.
Figure 4:
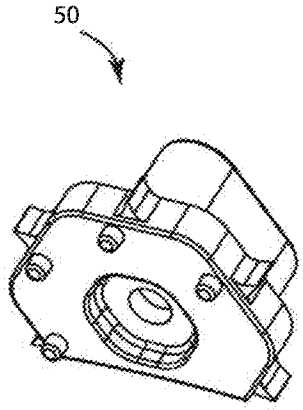
FIG. 4 is a bottom perspective view of a dial for incremental adjustment of a cutting angle in accordance with the present invention.
Figures 6, 6A:
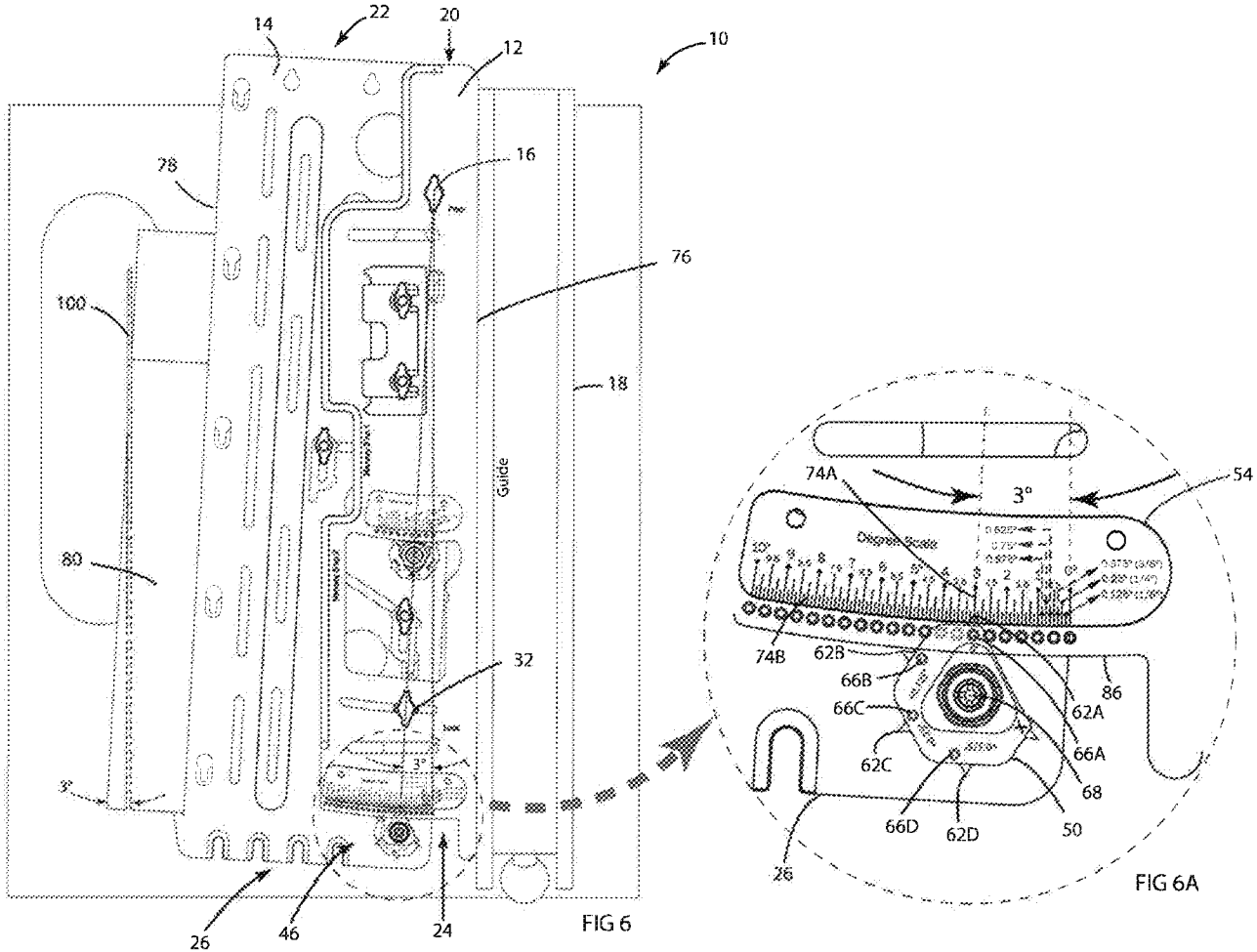
FIGS. 6 and 6A are top views of a gauge for a tapering jig with the cutting angle adjusted to a first position in accordance with the present invention.

The operation of the first gauge 46 to incrementally adjust a cutting angle will now be described. With respect to FIGS. 4 and 5, the dial 50 of the first gauge 46 is illustrated in more detail. As shown, the dial 50 includes a plurality of pointers 62A-62D spaced apart along an edge of the dial 50. In addition, the dial 50 includes a plurality of pins 66A-66D, wherein each pin 66A-66D is associated with a corresponding pointer 62A-62D. As the dial 50 is moveable up and down, the pins 66A-66D are inserted into a recess 72 when a desired angle is selected to lock the bottom plate 14 relative to the top plate 12. The first pin 66A is centered on a radial axis 68A taken from a central axis 68 of the dial 50. Thus in order to move the bottom plate 14 and second side edge 78, for example 3° as shown in FIGS. 6 and 6A, the dial 50 is lifted and the bottom plate 14 is pivoted so that the first pointer 62A is aligned with the 3° marking and the first pin 66A is inserted in the recess 72 associated with marking 74A on scale 54 by lowering the dial 50. As will be explained in more detail below a biasing mechanism such as a spring is connected to the dial 50 and biases the dial 50 downward against the bottom plate 14 to lock the bottom plate in position when the pin 66A is inserted in recess 74A.

In an embodiment, the dial 50 may include a pointer 114 that is not associated with a pin or any of the pins 66A-66D. One may use the dial 50 and rotate it so the pointer 114 is aligned with a particular marking 84A, 84B to set a cutting angle. Since a pin is not used to lock the plates 12 and 14 in position, the knobs 32, 36 may be used to lock in the position of the plates 12, 14. This may be done if one desires to further adjust the cut angle as desired.

In a preferred embodiment, gauge 46 may comprise a color coding scheme between the dial 50 and scale 54 to easily adjust the tapering jig 10 to a desired angle. That is each pointer 62A-62D, and/or associated incremental measurements, has a color that corresponds to the same color of a marking 74A, 74B on the scale 56 that represents the angle measurements on the dial 50. In this manner, the pointers 62A-62D may be readily aligned with a desired marking 74A, 74B for angle adjustment.

Figures 7, 7A:
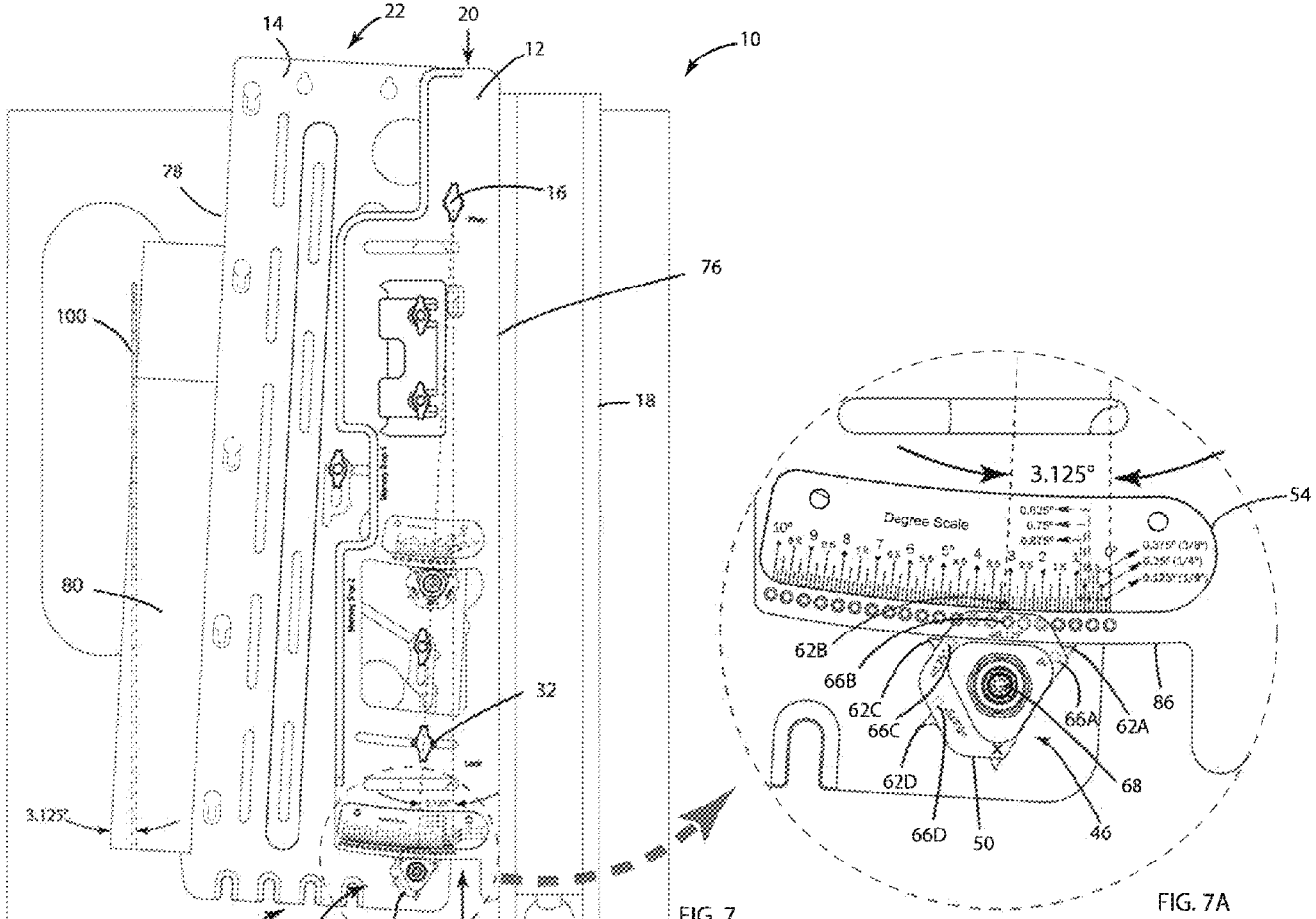
FIGS. 7 and 7A are top views of a gauge for a tapering jig with the cutting angle incrementally adjusted to a second position in accordance with the present invention.

In reference to FIGS. 7 and 7A, the dial 50 has been rotated to incrementally adjust the cutting angle to 3.125°. As shown in FIG. 5, a second pin 66B is positioned relative to pointer 62B such that the pin 66B is offset 0.125° relative to a radial axis 68B taken from the central axis 68 to the pointer 62B. Thus, if the cutting angle needs to be adjusted to 3.125°, the dial 50 is raised and the second pointer 62B is aligned with the 3.125° marking 74B on the first scale 54. The dial 50 is then lowered inserting the second pin 66B into the same recess 72 that the first pin 66A was inserted into when the angle was adjusted to 3°; however, because the second pin 66B is offset 0.125° relative to the second pointer 62B and axis 68B, the second edge 78 and the bottom plate 14 are pivoted an additional 0.125° to a cutting angle of 3.125°.

Figure 8A:
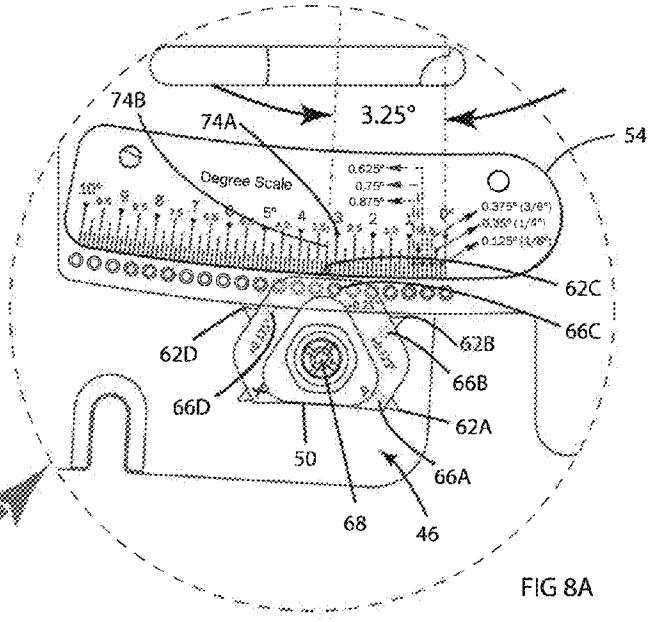
FIGS. 8 and 8A are top views of a gauge for a tapering jig with the cutting angle incrementally adjusted to a third position in accordance with the present invention.
Figure 8:
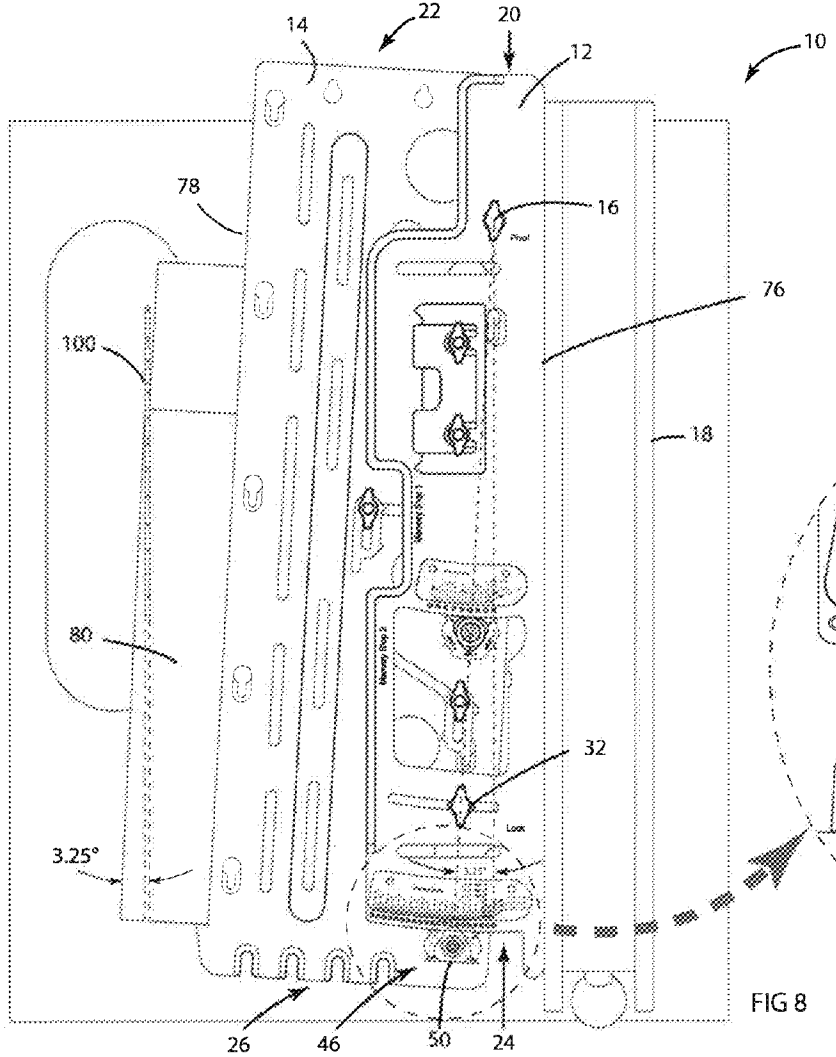
Figure 9A:
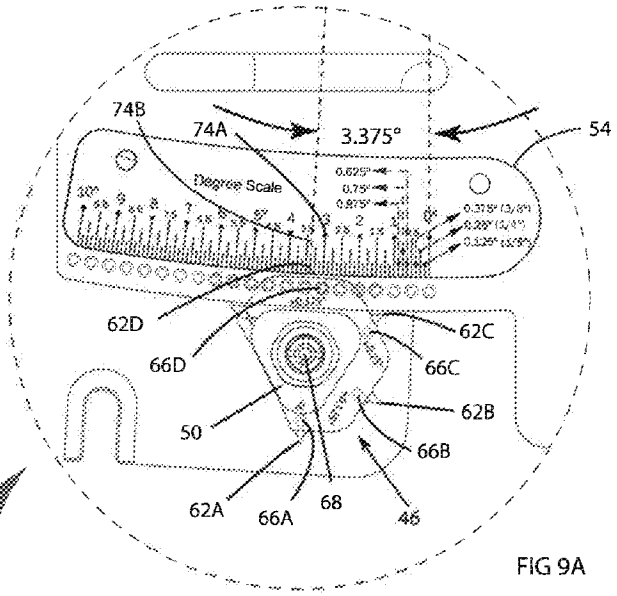
FIGS. 9 and 9A are top views of a gauge for a tapering jig with the cutting angle incrementally adjusted to a fourth position in accordance with the present invention.
Figure 9:
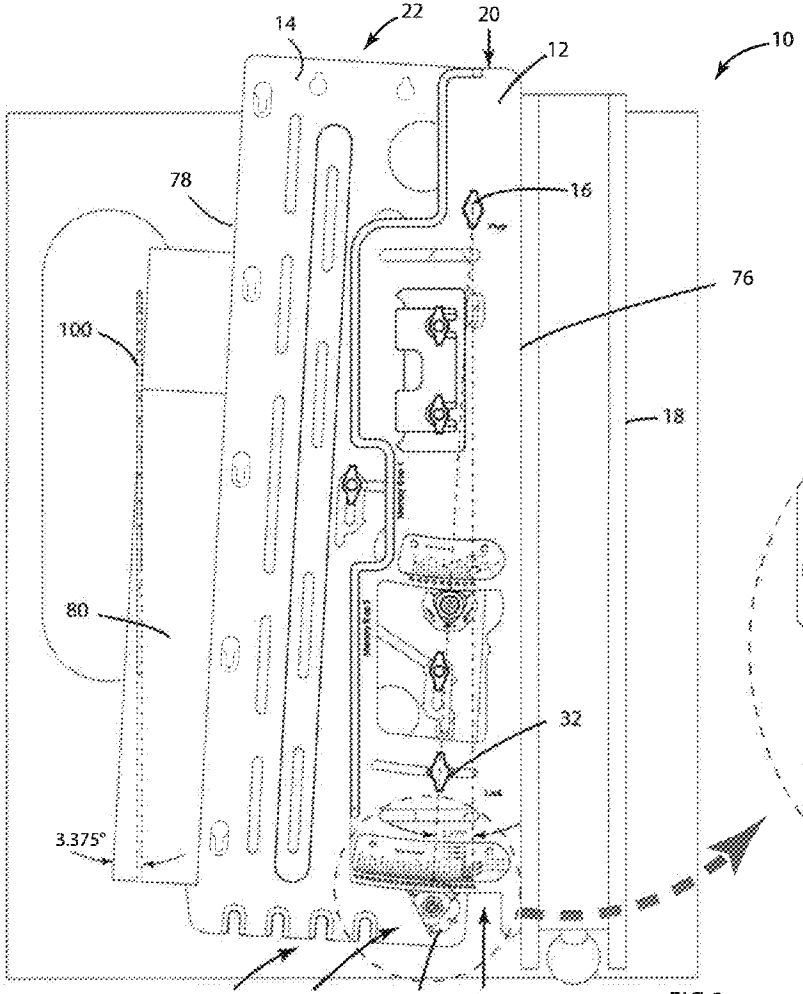

As shown in FIGS. 5, 8 and 8A, the dial 50 includes a third pin 66C associated with a third pointer 62C to adjust the cutting angle to 3.25° or an additional 0.125°. As shown in FIG. 5, the third pin 66C is positioned relative to the pointer 62C such that the pin 66C is offset 0.25° relative to a radial axis 68C taken from the central axis 68 to the pointer 62C. Thus, if the cutting angle needs to be adjusted to 3.25°, the dial 50 is raised and the third pointer 62C is aligned with the 3.25° marking on the first scale 54. The dial 50 is then lowered inserting the third pin 66C into the same recess that the first pin 66A was inserted into when the angle was adjusted to 3°; however, because the third pin 66C is offset 0.25° relative to the third pointer 62C or the radial axis 68C, the second edge 78 and the bottom plate 14 are pivoted an additional 0.25° to a cutting angle of 3.25°.

In reference to FIG. 6A, the dial 50 has been rotated to incrementally adjust the cutting angle to 3.375°. As shown in FIG. 5, a fourth pin 66D is positioned relative to pointer 62D such that the pin 66D is offset 0.375° relative to a radial axis 68D taken from the central axis 68 to the pointer 62D. Thus, if the cutting angle needs to be adjusted to 3.375°, the dial 50 is raised and the fourth pointer 62D is aligned with the 3.375° marking on the first scale 50. The dial 50 is then lowered inserting the fourth pin 66D into the same recess 72 that the first pin 66A was inserted into when the angle was adjusted to 3°; however, because the fourth pin 66D is offset 0.375° relative to the further pointer 62D or radial axis 68D, the second edge 78 and the bottom plate 14 are pivoted an additional 0.125° to a cutting angle of 3.375°.

The subject invention is not limited to the particular shape or configuration of the dial, 50 as shown herein. For example, instead of the truncated hexagonal shape, the shape of the dial may be circular or have truncated circular shape, or other shapes. In addition, more or less than four pointers and pins may be used to select an angle. The particular embodiment shown herein includes consecutive adjacent pointers that are disposed at an angle of about 60° relative to one another. Depending on the degree in incremental adjustment one may want to achieve, one may use more or fewer pointers and pins. To that end, other embodiments may include more or fewer markings. In the embodiment of the present invention illustrated in FIGS. 6-9A, a first set of markings 72A are provided every 0.5°, and the second set of markings between two first markings 72A are set at angle increments of 0.125°. However, for example markings 72A may be set every 1° and the secondary markings 72B may be spaced to adjust at 0.25° increments.

The above-described operation of the tapering jig 10 relates to the gauge 46 and scale 54, which includes angle measurements and markings on scale 54 for setting a desired angle at which the work piece 80 is disposed relative to the saw blade 100. The scale 54 may be advantageously used when drawings are provided that identify taper angles for the work piece 80, and a user may simply dial in the angle on the scale 54. However, people often calculate the taper angle and cut work pieces without the use of drawings or plans. One commonly used calculation used to determine a taper angle is the "rise and run" or "rise over run" calculation. The "rise and run" calculation is used to determine an amount of material to be removed at a bottom end 80A from the work piece 80, which may also be referred to as the "taper".

Typically one makes a lateral measurement, i.e. ¼", representing the amount of material (the "rise") to be removed from the end of the work piece and marks the measurement. Then the length (the "run") of the cut is measured along the edge of the work piece to be cut and the two points are connected by a diagonal line drawn on the work piece to represent the taper. When making the cut, one has to "eyeball" the cut along the line to maintain a straight cut. Both the measurement and cutting may lead to inaccuracies or an imprecise cut.

With respect to the present invention, if one knows the desired "rise" or amount of material to be removed, the top and bottom plates 12, 14 are adjusted accordingly and the dial 52 is used to lock the plates 12, 14 relative to one another at the desired measurement, and the tapering jig 10 is used to make a precise cut. In an embodiment of the invention, the "rise" measurements represented by markings 84 on the scale 56 have been determined per linear foot. Accordingly, if one desires make a cut that is short or longer than twelve inches the following known equation may be used:

$$\frac{\text{Rise (in.)} \times 12}{\text{Run (in.)}} = \text{Rise (in.)per foot}$$

For example if a ⅜" taper (rise, or amount of material to be removed) is desired for a 18" cut (run), then the dial 52 is set to ¼.

Figures 10, 10A:
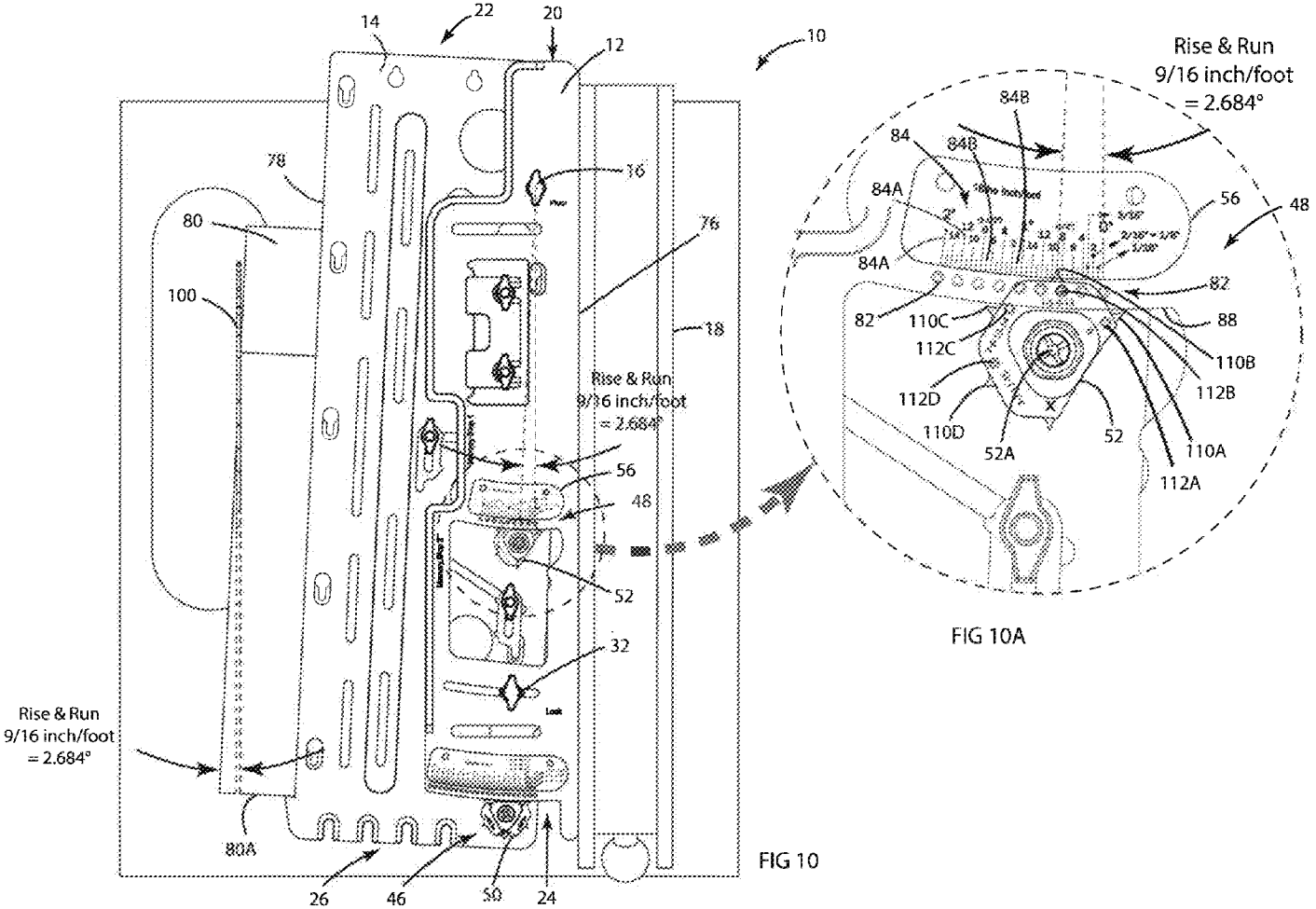
FIGS. 10 and 10A are top views of a gauge for a tapering jig with the cutting edge adjusted to a desired angle according to a rise/run measurement.

The FIGS. 10 and 10A illustrate gauge 48 used to adjust the jig 10 according to a "rise and run" measurement. As shown in FIG. 10, the bottom plate 14 has been moved relative to the top plate 12 to remove 9/16" from the end 80A of the work piece 80. Accordingly, the scale 56 shown in FIG. 10A includes markings 84 that are indicative of a lateral measurement along end 80A of an amount of a material to be removed at the end 80A of the work piece 80. By way of example the markings 84 represent incremental "rise/run" measurements of 1/16" per linear foot on a scale from zero to 2" per linear foot.

Also shown in FIG. 10A is dial 52 that has a configuration similar to that of dial 50 of gauge 46. More specifically, the dial 52 includes a plurality of pointers 110A-110D spaced apart along a perimeter or edge of the dial 52. In addition, the dial 52 includes a plurality of pins 112A-112D, wherein each pin 112A-112D is associated with a corresponding pointer 110A-110D. The gauge 48 further comprises a plurality of recesses 82 on the top plate 12 adjacent to the scale 56 and between the dial 52 and scale 56. Each recess 82 is associated with a plurality of markings 84 to incrementally adjust the "rise and run" measurement and a taper angle of a cut. In, the example shown in FIG. 10A, the markings 84 are set for incremental measurements at 1/16" per foot, and each recess 82 is associated with four markings. For example, the recess 82 directly aligned with the 1" marking is also use in conjunction with the dial 52 set the "rise and run" measurement at 1 1/16", 1 2/16 " and 1 3/16" measurements.

As further shown in FIG. 10A, each pin 112A-112D is positioned relative to its respective pointer such that each pin 112A-112D is insertable in the same recess 82 make incremental "rise and run" adjustments. More specifically, the pin 112A is directly aligned or centered relative to the 110A pointer along a radial axis taken from pivot axis 52A of the dial 52. Pin 112B is offset 1/16" relative to a radial axis from the dial center 52A to the pointer 110B; pin 112C is offset 2/16" relative to a radial axis from the dial center 52A to the pointer 110C; and, pin 112D is offset 3/16" relative to a radial axis from the dial center 52A to the pointer 110D.

The markings include a first set of markings 84A in which the pointer 110A and corresponding pin 112A are used to adjust the "rise and run" measurement at predetermined increments. In this example, the first pointer 110A and first pin 112A may be used to adjust the rise and run measurement to every ¼" per foot. That is from zero to 1" the pointer 110A and pin 112A are used to adjust the "rise and run" measurement to 4/16" (¼"), 8/16" (½"), 12/16" (¾") and 1". The remaining pointers 110B-110D and corresponding pins 112B-112D are used to adjust a rise and run measurement to fractions between two of these consecutive measurements associated with the first pointer 110A and pin 112A. Again, with respect to the example shown in FIG. 10A, the second pointer 110B and 112B are used to adjust the measurement to 1/16", 5/16", 9/16" and 13/16"; the third pointer 110C and 112C are used to adjust the measurement to 2/16", 6/16", 10/16" and 14/16"; and, the fourth pointer 110D and 112D are used to adjust the measurement to 3/16", 7/16", 11/16" and 15/16".

Similar to the angle gauge 46, the gauge 48 may comprise a color coding scheme between the dial 52 and scale 56 to easily adjust the tapering jig 10 to a desired angle. That is each pointer 110A-110D, and/or associated incremental measurements, has a color that corresponds to the same color of a marking 84A, 84B on the scale 56 that represents the measurement on the dial 52.

Given, the small fractional adjustments of the gauge 48, a recess 82 cannot practically be provided for each 1/16" marking. Accordingly, each recess 82 is associated with multiple consecutive measurement increments or markings; and, the same recess may be used to adjust the measurement at 1/16" increments. As shown in FIGS. 10 and 10A, the tapering jig 10 has been adjusted to a 9/16" per foot measurement so that 9/16" of material of the work piece 80 is removed at end 80A. Accordingly, the dial 52 is rotated so that second pointer 110B, which provides for a 9/16" measurement, is aligned with the 9/16" marking 84B and the pin 112B is inserted in the recess 82 that is aligned with the 8/16" marking; however, because the pin 112B is offset 1/16" relative to the pointer 110B, the jig 10 or second plate 14 is adjusted to the 9/16" per foot "run and rise" measurement. Similarly, if the desired measurement is 10/16" (or 5/16"), the third pointer 110C is aligned with the 10/16" marking and the pin 112C is inserted in the same recess 82; however, because the pin 112C is offset 2/16" relative to the pointer 110C, the jig 10 or second plate 4 is adjusted to the 10/16" per foot "run and rise" measurement. If the desired measurement is 11/16", the fourth pointer 110D is aligned with the 11/16" marking and the pin 112D is inserted in the same recess 82; however, because the pin 112D is offset 3/16" relative to the pointer 110D, the jig 10 or second plate 14 is adjusted to the 11/16" per foot "run and rise" measurement. In this manner, because of the incremental offset settings of the pointers 112A-D relative to the respective pointers 110A-110D, the same recess 82 may be used to make multiple different measurements.

Figure 11:
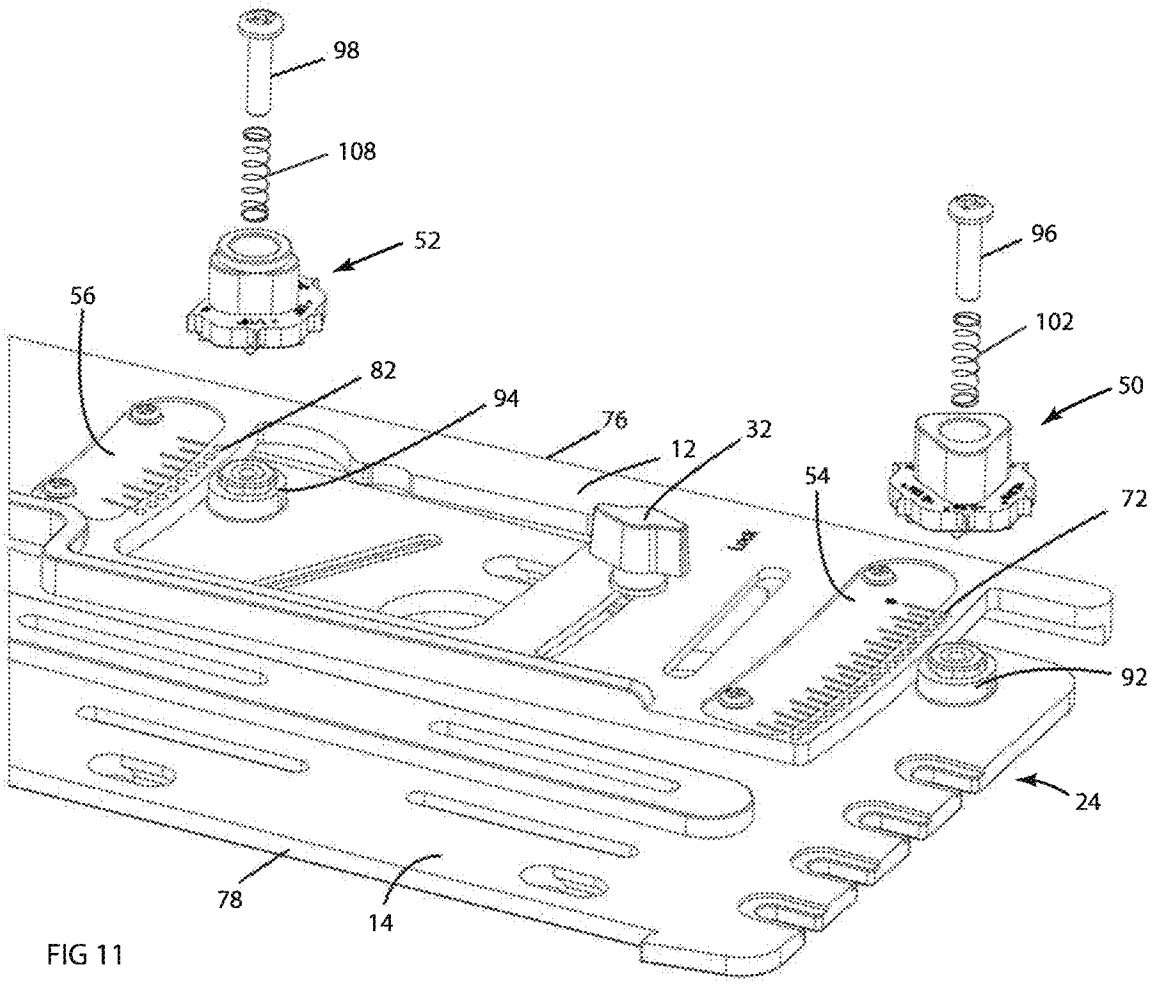
FIG. 11 is an exploded view of a dial of a gauge for the tapering jig in accordance with the present invention.

With respect to FIG. 11, an exploded view of the dials 50 and 52 is illustrated and is also representative of the second dial 52, which is arranged in a similar configuration. As described above, the dials 50, 52 are moveable up and down to adjust relative positions of the top and bottom plates 12, 14 and the cutting angle of the work piece 80 (not shown in FIG. 10) relative to a saw blade 100. A biasing mechanism is provided to bias the dial 50 against the bottom plate 14 to seat a pin 66 within a corresponding recess 72. Bosses 92, 94 are on the bottom plate 14 and each receives a respective bolt 96, 98 and spring 102, 108. Each bolt 96, 98 is inserted through a aperture in the respective dial 50, 52 and threaded into the bottom plate 14 within the boss 92, 94 with the spring 102, 108 disposed between the bolt 96, 98 and dial 50, 52. In this manner, the dials 50, 52 can be raised to adjust the angle of second edge 78 relative to the first edge 76 or guide rail 18 to form a desired cutting angle. When a pin 66 on dial 50, for example, is aligned with the appropriate recess 72, the dial 50 is released and the spring 102 biases the dial 50 toward the second plate 14 so the pin 62 seats in a recess 72 to fix the plates 12, 14 in place relative to one another.

The subject invention for a tapering jig may also be particularly useful for cutting work pieces that have multiple tapered sides. When making a taper cut on two opposed sides of the same piece of stock material, one may appreciate that the set-up for the second cut must include consideration of the taper that was previously made on the first side of the material. Thus, tapering device 10 may be set to 2° for a first cut, then 4° for a second cut on the opposed side of the same piece of material. When making multiple such pieces, it may be necessary to repeatedly change the setting of tapering jig 10 from one angle to another. To facilitate such an operation, two memory stops 28, 30 are provided on bottom plate 14. A first angle is selected and first memory stop 28 is moved in slot 104 to abut top plate 12 and locked into position. A second, greater angle is then selected and second memory stop 30 is moved in slot 106 to abut top plate 12 and locked into position. The jig 10 may then be quickly switched between the first angle and the second angle by simply loosening locking knob 32, sliding bottom plate 14 until it abuts either first memory stop 28 or second memory stop 30, then again tightening locking knob 32.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

What is claimed is:

1. A tapering jig for a woodworking apparatus, comprising:

a bottom plate having a first end and a second end;

a top plate having a first end and a second end, wherein the top plate and bottom plate are operatively connected toward their respective first ends to pivot relative to one another at a pivot axis;

wherein the tapering jig has a first edge along the top plate for abutment against a guide rail of a woodworking apparatus and a second edge along the bottom plate for abutment against a work piece to be cut;

at least one gauge for selecting an angle to which the second edge is disposed relative to the first edge or a guide rail, the gauge comprising:

a plurality of recesses aligned in a top surface of the top plate along a lateral edge of the top plate extending generally laterally relative to the first and second edges of the tapering jig, and each recess is disposed at a predetermined angle relative to the pivot axis, when the first edge is parallel to the guide rail;

a dial mounted to the bottom plate adjacent to the lateral edge and recesses of the top plate, and the dial being rotatable about a vertical central axis thereof, wherein the dial has a plurality of pointers along an edge thereof, and a plurality of pins depending from a bottom surface of the dial, each pin being associated with a respective pointer, and the dial is positioned relative to the recesses and moveable up and down to insert a pin into a respective recess when the bottom plate is positioned or pivoted relative to the top plate to set an angle at which the second edge is disposed relative to the first edge or a guide rail; and, a scale on the top surface of the top plate adjacent to the recesses including markings representing a plurality of angular measurements and for each recess there is an associated plurality of the markings representing multiple angular positions that the second edge may be disposed relative to the first edge when the bottom plate is pivoted relative to the top plate and a pointer is aligned with one of the plurality of markings and the respective pin is inserted in the associated recess.

2. The tapering jig of claim 1, wherein the plurality of pointers includes a first pointer and the plurality of pins includes a first pin associated with the first pointer wherein the first pin is centered relative to the first pointer on a radial axis taken from the center of the dial, and the first pin is insertable in a recess to position the second edge relative to the first edge a predetermined angle, and each other pin is offset an incremental predetermined angle relative to a radial axis taken from center of the dial to the respective pointer and insertable in the same recess to incrementally adjust the angle of the second edge relative to the first edge.

3. The tapering jig of claim 2, wherein the angle of offset increases from one pointer to the next consecutive pointer when increasing the angle at which the second edge is disposed relative to the first edge or guide rail.

4. The tapering jig of claim 1, wherein each pointer is spaced apart from a next consecutive pointer at an angle of 60°.

5. The tapering jig of claim 1, wherein the markings represent the angle measured in degrees the second edge is disposed relative to the first edge or guide rail, or an angle in degrees at which a work piece is disposed relative to a cutting element.

6. The tapering jig of claim 1, wherein the markings on the scale represent a lateral measurement of end of the work piece to be removed relative to a length of the work piece that is cut.

7. The tapering jig of claim 1, further comprising a first memory stop connected to the bottom plate for abutting the top plate when it is positioned at a first plurality of angles, and a second memory stop connected to the bottom plate for abutting the top plate when it is positioned at a second of the plurality of angles.

8. The tapering jig of claim 1, wherein the lateral edge has a radius of curvature based on the distance a center of the dial is from the pivot axis.

9. The tapering jig of claim 1, wherein the pins, other than the first pin, are offset an incremental predetermined angle relative to a radial axis taken from center of the dial to the respective pointer at least ⅛ of a degree.

10. The tapering jig of claim 1, wherein the pins, other than the first pin, are offset at least 1/16 of an inch relative to a radial axis taken from center of the dial to the respective pointer.

11. A tapering jig for a woodworking apparatus, comprising:

a bottom plate having a first end and a second end;

a top plate having a first end and a second end, wherein the top plate and bottom plate are operatively connected toward their respective first ends to pivot relative to one another at a pivot axis;

wherein the tapering jig has a first edge along the top plate for abutment against a guide rail of a woodworking apparatus and a second edge along the bottom plate for abutment against a work piece to be cut;

at least one gauge for selecting an angle to which the second edge is disposed relative to the first edge or a guide rail, the gauge comprising:

a plurality of recesses aligned in a top surface of the top plate along a lateral edge of the top plate extending generally laterally relative to the first and second edges of the tapering jig, and each recess is disposed at a predetermined angle relative to the pivot axis;

a dial mounted to the bottom plate adjacent to the lateral edge and recesses of the top plate, and the dial being rotatable about a vertical central axis thereof, wherein the dial has a plurality of pointers along an edge thereof, and a plurality of pins depending from a bottom surface of the dial, each pin being associated with a respective pointer, and the dial is positioned relative to the recesses and moveable up and down to insert a pin into a respective recess when the bottom plate is positioned or pivoted relative to the top plate to set an angle at which the second edge is disposed relative to the first edge; and, wherein the plurality of pointers includes a first pointer and the plurality of pins includes a first pin associated with the first pointer wherein the first pin is centered relative to the first pointer on a radial axis taken from the center of the dial, and the first pin is insertable in a recess to position the second edge relative to the first edge a predetermined angle, and each other pin is offset an incremental predetermined angle relative to a radial axis taken from center of the dial to the respective pointer and insertable in the same recess to incrementally adjust the angle of the second edge relative to the first edge.

12. The tapering jig of claim 11, further comprising a scale on the top surface of the top plate adjacent to the recesses including markings representing a plurality of angular measurements and for each recess there is an associated plurality of the markings representing multiple angular positions that the second edge may be disposed relative to the first edge when the bottom plate is pivoted relative to the top plate and a pointer is aligned with one of the plurality of markings and the respective pin is inserted in the associated recess.

13. A tapering jig for a woodworking apparatus, comprising:

a bottom plate having a first end and a second end;

a top plate having a first end and a second end, wherein the top plate and bottom plate are operatively connected toward their respective first ends to pivot relative to one another at a pivot axis;

wherein the tapering jig has a first edge along the top plate for abutment against a guide rail of a woodworking apparatus and a second edge along the bottom plate for abutment against a work piece to be cut;

at least one gauge for selecting an angle to which the second edge is disposed relative to the first edge or a guide rail, the gauge comprising:

a plurality of recesses aligned in a top surface of the top plate along a lateral edge of the top plate extending generally laterally relative to the first and second edges of the tapering jig, and each recess is disposed at a predetermined angle relative to the pivot axis;

a dial mounted to the bottom plate adjacent to the lateral edge and recesses of the top plate, and the dial being rotatable about a vertical central axis thereof, wherein the dial has a plurality of pins depending from a bottom surface of the dial, and the dial is positioned relative to the recesses and moveable up and down to insert a pin into a respective recess when the bottom plate is positioned or pivoted relative to the top plate to set an angle at which the second edge is disposed relative to the first edge; and, wherein the plurality of pins includes a first pin that is centered relative to a radial axis taken from the center of the dial, and the first pin is insertable in a recess to position the second edge relative to the first edge a predetermined angle, and each other pin is offset an incremental predetermined angle relative to a radial axis taken from center of the dial and insertable in the same recess to incrementally adjust the angle of the second edge relative to the first edge.

14. The tapering jig of claim 13, further comprising a plurality of pointers and each pointer is associated with a respective pin the plurality of pointers includes a first pointer associated with the first pin wherein the first pin is centered relative to the first pointer on the radial axis taken from the center of the dial, and each other pin is offset an incremental predetermined angle relative to the radial axis taken from center of the dial to the respective pointer.

15. The tapering jig of claim 14, further comprising a scale on the top surface of the top plate adjacent to the recesses including markings representing a plurality of angular measurements and for each recess there is an associated plurality of the markings representing multiple angular positions that the second edge may be disposed relative to the first edge when the bottom plate is pivoted relative to the top plate and a pointer is aligned with one of the plurality of markings and the respective pin is inserted in the associated recess.

16. The tapering jig of claim 14, wherein the angle of offset increases from one pointer to the next consecutive pointer when increasing the angle at which the second edge is disposed relative to the first edge or guide rail.

* * * * *